US006293644B1

(12) United States Patent
Markham et al.

(10) Patent No.: US 6,293,644 B1
(45) Date of Patent: Sep. 25, 2001

(54) METHOD AND APPARATUS FOR PREVENTING SATELLITE INDUCED BANDING IN AN INK JET PRINTER USING PRE-PULSE COMPENSATION

(75) Inventors: Roger Guy Markham; Yonglin Xie, both of Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/593,805

(22) Filed: Jun. 15, 2000

Related U.S. Application Data

(60) Provisional application No. 60/200,875, filed on May 1, 2000.

(51) Int. Cl.[7] ..... B41J 29/393; B41J 29/38; B41J 2/05

(52) U.S. Cl. ..... 347/19; 347/11; 347/56

(58) Field of Search ..... 347/19, 60, 17, 347/56, 54, 20, 14, 37, 11

(56) References Cited

U.S. PATENT DOCUMENTS 5,369,428 * 11/1994 Maze et al. ..... 347/37
5,561,449 * 10/1996 Raskin et al. ..... 347/37
5,821,952 * 10/1998 Martenson et al. ..... 347/8
5,838,340 * 11/1998 Shimoda ..... 347/60
5,992,968 * 11/1999 Uetsuki et al. ..... 347/37
6,102,515 * 8/2000 Edwards et al. ..... 347/17

* cited by examiner

*Primary Examiner*—John E. Barlow, Jr.
*Assistant Examiner*—Robert D Loper, Jr.
(74) *Attorney, Agent, or Firm*—Oliff & Berridge, PLC

(57) ABSTRACT

The present system counteracts the distorting effect of a bi-directional print head by reducing the visual effect of a satellite drop displacement when the print head is traveling in a direction that increases the satellite displacement from a main drop. The system can also counteract the distorting effect of the bi-directional print head by increasing the visual effect of a satellite drop misplacement when the print head is traveling in a direction that decreases the satellite misplacement from the main drop. The satellite drop displacement can be adjusted by correcting a measured ink temperature, and thereby, an amount of pre-pulsing prior to ejection of the ink.

15 Claims, 8 Drawing Sheets

300

302

304

| TEMPERATURE °C | PREPULSE | | | | | | | | | | | |
|---|---|---|---|---|---|---|---|---|---|---|---|---|
| | ON | OFF | ON | OFF | ON | OFF | ON | OFF | ON | OFF | ON | OFF |
| 25 | 0.250 | 0.625 | 0.125 | 0.625 | 0.250 | 0.625 | 0.125 | 0.625 | 0.250 | 0.625 | 2.375 | |
| 30 | | | | | 0.250 | 0.625 | 0.125 | 0.625 | 0.250 | 0.625 | 2.500 | |
| 35 | | | | | | | | | 0.250 | 0.625 | 2.625 | |
| 40 | | | | | | | | | | | 2.625 | |
| 45 | | | | | | | | | | | 2.625 | |
| 50 | | | | | | | | | | | 2.500 | |
| 55 | | | | | | | | | | | 2.375 | |

FIG. 3

METHOD AND APPARATUS FOR PREVENTING SATELLITE INDUCED BANDING IN AN INK JET PRINTER USING PRE-PULSE COMPENSATION

This Non-Provisional Application claims the benefit of U.S. Provisional Application No. 60/200,875 entitled "METHOD AND APPARATUS FOR PREVENTING SATELLITE INDUCED BANDING IN AN INK JET PRINTER USING PRE-PULSE COMPENSATION" which was filed on May 1, 2000 and is hereby incorporated by reference in its entirety. The Applicants of the Provisional Application are Roger G. Markham and Yonglin Xie.

BACKGROUND OF THE INVENTION

1. Field of Invention

This invention relates to ink jet printers.

2. Description of Related Art

A thermal ink jet print head selectively ejects droplets of ink from a plurality of drop emitters to create a desired image on an image receiving member, such as a sheet of paper. The print head typically comprises an array of the drop emitters that convey ink to the image receiving member. In a carriage-type ink jet print head, the print head moves back and forth relative to the image receiving member to print the image in swaths which are many pixels tall.

An ink jet print head typically comprises a plurality of ink passageways, such as capillary channels. Each channel has a nozzle and is connected to an ink supply manifold. Ink from the manifold is retained within each channel until, in response to an appropriate signal applied to a resistive heating element in each channel, the ink and a portion of the channel adjacent to the heating element is rapidly heated and vaporized. Rapid vaporization of some of the ink in the channel creates a bubble that causes a quantity of ink, i.e., an ink droplet, to be ejected from the emitter to the image receiving member. When an ink droplet is ejected at a velocity greater than approximately 5 m/s, the ink droplet is usually accompanied by one or more small sub-drops called satellites.

When a quantity of ink in the form of a ink droplet is ejected from the ejector to a receiving member, the resulting spot and any satellite drops become part of a desired image. Uniformity in spot size of a large number of droplets is very important for image quality. If the volume of droplets ejected from the print head over the course of producing a single document are permitted to vary widely, the lack of uniformity will have noticeable effects on the quality of the image. The most common and important cause of variance in the volume of droplets ejected from the print head is variations in the temperature of the print head over the course of use. The temperature of the liquid ink, before vaporization by the heating element, substantially affects both the bubble growth behavior and the viscosity of the ink. These two properties substantially influence the ejection volume of the ink droplets, and thus the resulting spot size on the image receiving member. The viscosity of the ink also directly affects the resulting spot size, by affecting the spread rate of the droplet after it contacts the image recording member. Control of temperature of the print head has long been of primary concerns in the art.

In order to maintain a constant spot size from an ink jet print head, various strategies have been attempted. One example is U.S. Pat. No. 4,899,180 to Elhatem et al., which is incorporated herein by reference in its entirety. In the'180 patent, the print head has a number of heater resistors and a temperature sensor that operate to heat the print head to an optimum operating temperature and maintain that temperature regardless of local temperature variations.

U.S. Pat. No. 4,791,435 to Smith et al., which is incorporated herein by reference in its entirety, discloses an ink jet system where the temperature of the print head is maintained by using the heating elements of the print head not only for ink ejection but also to maintain the temperature. The print head temperature is compared to thermal models of the print head to provide information for controlling the print head temperature. At low temperature, low energy pulses, i.e., pre-pulses, are sent to each channel, or nozzle, at a voltage that is below the voltage threshold that causes a ink droplet to be ejected. Alternatively, the print head can be warmed by firing some droplets of ink into an external chamber or "spittoon," rather than onto the image receiving member.

SUMMARY OF THE INVENTION

As described above, the satellite drops are usually smaller than the main drop and travel at a lower speed than the main drop. As a result, the satellite drops can land on different locations of the image receiving member relative to the main drop during printing when the drop ejector and the image receiving member are moving relative to each other. Furthermore, the satellite drop can land at different locations from the main drop because the satellite drops generally have a velocity vector that is slightly different from that of the main drop. This satellite drop displacement can increase or decrease with increasing print head speeds and with an increased gap between the print head and the image receiving member.

Because the satellite drops occasional travel in slightly different directions relative to the main drop, the effect of the satellite drops on the image quality can differ based on a traveling direction of the print head. In one exemplary embodiment of a conventional print head, the print head transfers ink onto the image receiving member as the print head travels from right-to-left and left-to-right relative to the image receiving member, i.e., a bi-directional print head. Furthermore, while in a stationary position, the nozzles of this print head create satellite drops having velocity vectors which direct satellite drops to land slightly to the left of a main drop on the image receiving member.

As the print head passes from right-to-left and transfers ink onto the image receiving member, the velocity vector of the print head in conjunction with the velocity vectors of the satellite drops cause the satellite drops to land further away from the main drop on the image receiving member relative to that of the satellite drops of the print head when stationary. In other words, the satellite drops will lag even further behind the main drop due to the additional print head velocity vector.

On a return swath, as this print head moves from left-to-right and transfers ink onto the image receiving member, the velocity of the print head causes the satellite drops to land closer to, or actually within, the main drop on the image receiving member. The differing positions of the satellite drops relative to the main drop causes variations in the appearance between swaths formed by a left-to-right pass versus a swath formed by a right-to-left pass. Accordingly, this effect causes bidirectional banding in the final image because the patterns formed by drops printed in one direction are different from those printed in the other direction.

This invention counteracts the distorting effect of the bi-directional print head by reducing the volume of emitted ink when the print head is traveling in a direction that increases the satellite misplacement from the main drop. The emitted ink volume can be reduced by reducing an amount of pre-pulsing prior to ejection of the ink. Reducing the amount of pre-pulsing prior (generally a period of several micro-seconds) to the ejection of the ink can reduce the ink's temperature causing a smaller, less forceful, bubble to eject a more viscous ink from the channel. This combination of a smaller bubble and a more viscous ink in the channel can result in a smaller spot being formed on the receiving member and it can also affect the satellite displacement.

This invention can also counteract the distorting effect of the bi-directional print head by increasing the emitted ink volume when the print head is traveling in a direction that decreases the satellite displacement from the main drop. The emitted ink volume can be increased by increasing the amount of pre-pulsing prior to ejection of the ink. Increasing the amount of pre-pulsing prior to ejection of the ink can cause a larger, more forceful, bubble to eject a less viscous ink from the channel. This combination of larger bubble and less viscous ink can result in a larger spot being formed on the receiving member and it can also affect the satellite displacement.

As a result of these two effects, the overall appearance of right-to-left swaths more closely matches that of left-to-right swaths. Other objects, advantages and salient features of the invention will become apparent from the following detailed description taken in conjunction with the drawings, which disclose preferred embodiments of the invention.

BRIEF DESCRIPTION OF THE DRAWINGS

The invention will be described with reference to the following drawings in which like reference numerals refer to like elements, and wherein:

FIG. 3 is an exemplary data structure for storing pre-pulsed sequence patterns corresponding to temperatures;

DETAILED DESCRIPTION OF PREFERRED EMBODIMENTS

Figure 1:
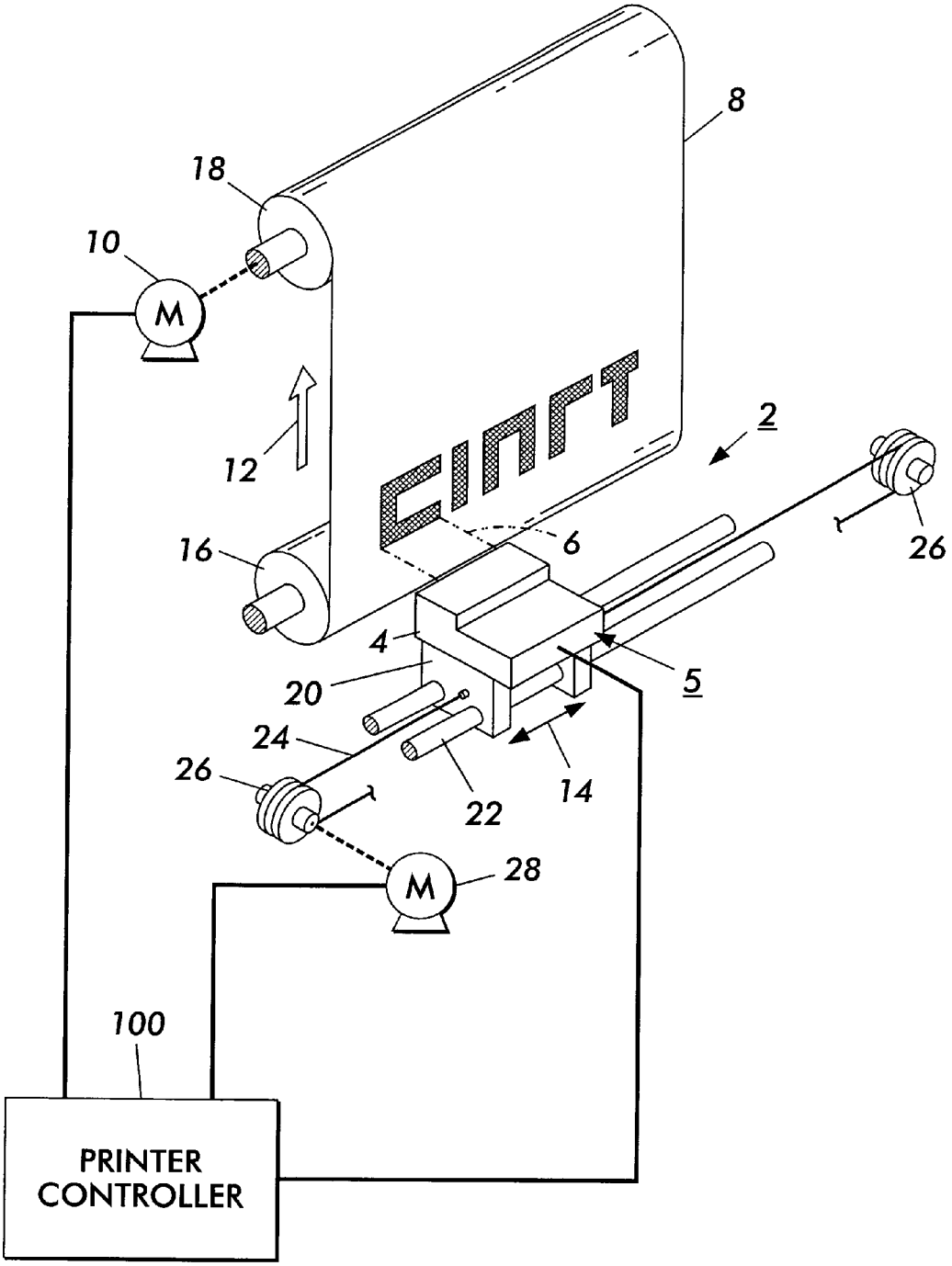
FIG. 1 is a schematic view of a printing system in accordance with the present invention.

FIG. 1 shows an exemplary carriage-type ink jet printing device 2. A vertically linear array of droplet producing channels is housed in the print head 4 of a reciprocal carriage assembly 5. Ink droplets 6 are propelled to a recording medium 8, such as a sheet of paper, that is stepped by a motor 10 a preselected distance (often equal to the size of the array) in a direction of arrow 12 each time the print head 4 traverses across the recording medium 8 in the directions indicated by arrow 14. The recording medium 8 can be stored on a supply roll 16 and stepped onto takeup roll 18 by stepper motor 10 or other structures, apparatuses or devices well known to those of skill in the art.

The print head 4 is fixedly mounted on the support base 20, which is adapted for reciprocal movement using any well known structure, apparatus or device, such as two parallel guide rails 22. The reciprocal movement of the print head 4 may be achieved by a cable 24 and a pair of pulleys 26, one of which is powered by a reversible motor 28. The print head 4 is generally moved across the recording medium 8 perpendicularly to the direction the receiving member 8 is moved by the motor 10. Of course, other structures for reciprocating the carriage assembly 5 are possible.

The ink jet printing device 2 is operated under the control of a print controller 100. The print controller 100 transmits commands to the motors 10 and 28 and the print head 5 to produce an image on the image recording medium 8. Furthermore, the print head controller 100 receives information from the various components of the ink jet printing system 2. For example, the print head controller 100 receives measurements of ink temperature from a temperature sensor located in print head 5.

Figure 2:
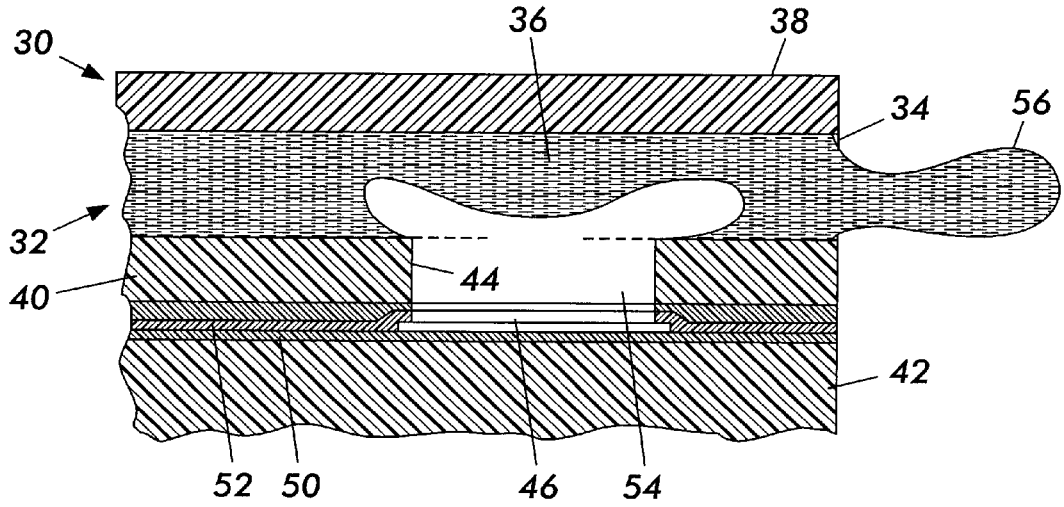
FIG. 2 is a cross-sectional view of a single ejector channel for a prior art ink jet print head.

FIG. 2 shows one exemplary embodiment of an ink droplet emitter, or ejector 30, of the ink jet print head 4. The ink droplet ejector 36 is one of a large plurality of such emitters found in a typical ink jet print head. While FIG. 2 shows a side-shooter emitter, other emitters such as roof-shooter emitters may similarly be used with this invention. Typically, such emitters are sized and arranged in linear arrays of 300 to 600 emitters per inch, although other arrangements are known to one skilled in the art. A silicon member having a plurality of channels for ink droplet emission is known as a "die module" or "chip". Each die module typically comprises hundreds of emitters, spaced 300 or more to the inch. An ink print head may have one or more die modules extending the effective size of the array. In print heads with multiple die modules, each die module may include its own ink supply manifold, or multiple die modules may share a common ink supply manifold.

Each emitter 30 includes a capillary channel 32 terminating in an orifice or nozzle 34. The channel 32 holds a quantity of ink 36 maintained within the capillary channel 32 until such time as a droplet of ink is to be emitted. Each capillary channel 32 is connected to a supply of ink from an ink supply manifold (not shown). The upper substrate 38 abuts a thick film layer 40, which in turn abuts a lower substrate 42.

Sandwiched between the thick-film layer 40 and the lower substrate 42 are electrical heating elements 46 used to eject ink droplets from the capillary channel 32 in a well-known manner. The heating element 46 may be located within a recess 44 formed by an opening in a thick film layer 40. The heating element 46 is directly or indirectly electrically connected to an addressing electrode 50. Each of the ejectors 30 in the print head 4 may have its own heating element 46 and an individual addressing electrode 50. The addressing electrode 50 may be protected by a passivation layer 52. Each addressing electrode 50 and corresponding heating element 46 may be selectively controlled by control circuitry. Other embodiments of the ink jet print head are well known to one skilled in the art and are also within the scope of this invention.

As is well as known in the art, when a print pulse is applied to the addressing electrode 50, the heating element 46 is energized. The print pulse is a signal that is of a sufficient magnitude and/or duration so that the heat from the resistive heating element 46 will cause the liquid ink immediately adjacent to the heating element 46 to vaporize, creating a bubble 54 of vaporized ink. The force of the expanding bubble 54 ejects an ink droplet 56, which may include a main droplet and smaller satellite drops, from the nozzle 34 onto the surface of the recording medium 8.

Furthermore, under the control of the print controller 100, thermal ink jet print heads may apply a plurality of pre-pulses to the heating element 46 prior to ejecting each ink droplet 56. Typically, one or more pre-pulses may be applied by the heating element 46 prior to a print pulse in order to warm the ink prior to ejection. The amount and timing of the pre-pulse can vary as a function of the temperature of the ink.

For example, FIG. 3 shows a pre-pulse table 300 having an ink temperature in a field 302 and a corresponding pre-pulse sequence in a field 304. As shown in this example, for an ink temperature of 40° C. the pre-pulse sequence is absent while at 25° C. there is an extended pre-pulse sequence. For temperatures above 40° C., the adjustment (if any) is contained in the main (ejecting) pulse itself. The pre-pulse signals may be used to raise the temperature of the ink adjacent the heating element 46, and additionally may be used to control the volume of ink droplet 56. The pre-pulse signals do not contain enough energy to cause the ink droplet 56 to be emitted before the main (last) pulse.

Subsequent to any pre-pulse sequences, the print pulse, i.e., the drive pulse, firing pulse or main pulse, may be applied to the heating element 46. As described above, the print pulse causes the ink droplet 56 to be ejected on to the image receiving member 8.

Figure 4:
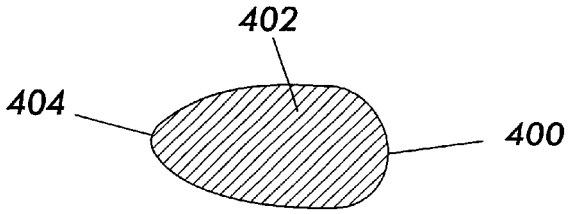
FIGS. 4–6 are exemplary spot patterns formed on a receiving member.
Figure 5:
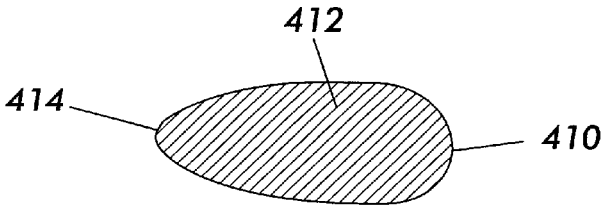
Figure 6:
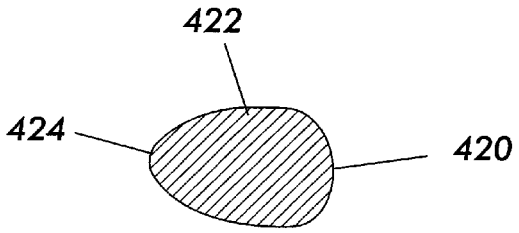

FIGS. 4, 5 and 6 show three different spot patterns 400, 410 and 420 formed by a typical nozzle 34 of a print head 4. For simplicity of explanation, each of the spot patterns 400, 410 and 420 includes a main spot portion 402, 412 and 422, respectively, and a satellite spot portion 404, 414 and 424, respectively. As described above, the spot portions 402, 412 and 422 describe where the majority of ink ejected from the nozzle 34 lands upon the image recording medium 8. The satellite spot portions 404, 414 and 424 are portions of the ink spots formed by satellite drops having slightly different velocity vectors than the main drops that form the main spot portions 402, 412 and 422. As a result, the satellite spot portions 404, 414 and 424 land upon the recording medium 8 at slightly different positions from the main spot portions 402, 412 and 422. The farther the satellite drop lands away from the main spot portions 402, 412 and 422, the more elongated the spot patterns 400, 410 and 420 become.

FIG. 4 shows a spot pattern 400 formed by a nozzle 34 that is held in a stationary position relative to the image recording medium 8. As shown in FIG. 4, the satellite spot portion 404 is positioned slightly to the left of the main spot portion 402 on the image recording medium 8. This is because the velocity vector of the satellite drop as it is ejected from the nozzle 34 is slightly different from the velocity vector of the main drop. As a result, as the ink is ejected from the nozzle 34 and travels towards the image recording medium 8, the satellite drop travels slightly to the left in accordance with the difference in the velocity vectors.

FIG. 5 shows a spot pattern 410 formed by a nozzle 34 of the print head 4, as the print head 4 travels from right-to-left relative to the image recording medium 8. As shown in FIG. 5, the satellite spot portion 414 now extends a greater distance to the left relative to the satellite spot portion 404 of FIG. 4. The "stretching" of the spot pattern 410 is due to the additional velocity vector imparted to the satellite drop by the print head 4 traveling in a right-to-left direction relative to the image recording medium 8. In other words, as the print head 4 travels from right-to-left, the difference between the velocity vectors of the main drop and the satellite drop increases. The overall effect of the increased difference in the velocity vectors is to increase the distance between the landing positions of the satellite drop forming the satellite spot portion 414 and the main drop forming the main spot portion 412.

FIG. 6 shows a spot pattern 420 formed by the same print head 4 moving in a left-to-right direction relative to the image receiving member 8. As shown in FIG. 6, the satellite spot portion 424 of the spot pattern 420 is positioned relatively closer to the main spot portion 422 relative to the spot pattern 400. The "compression" of the spot pattern 420 is due to the velocity of the print head when moving in the left-to-right direction decreasing the difference between the velocity vectors of the main drop and the satellite drop. In other words, the satellite drop forming the satellite spot portion 424 now lands in a position closer to that of the main drop forming the main spot portion 422 on the image recording medium 8.

Figure 7:
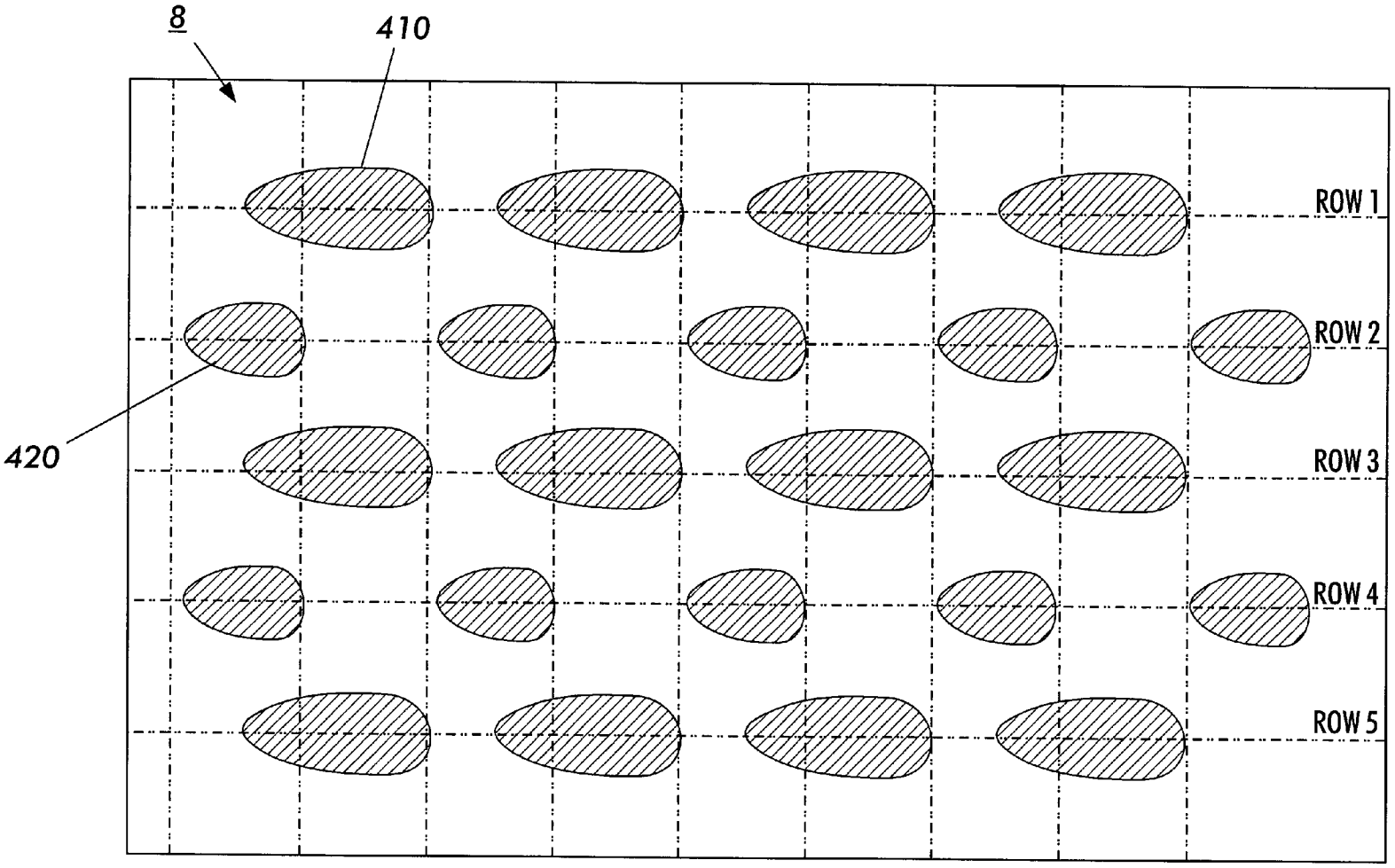
FIG. 7 is a portion of an exemplary image formed on a receiving member.

FIG. 7 shows a recording medium 8 having a series of spot patterns 410 and 420 formed on the recording medium 8 in a "checker-board" pattern. For illustration purposes only, a swath having only a single spot is shown. However, it is to be understood that generally print heads produce a swath path that is several spots in height. The checker-board pattern has a pixel distribution where every other pixel in a row has an ink spot, and every other row is offset from an adjacent row by one pixel. As shown in FIG. 5, the pattern includes rows 1,3 and 5 formed by a print head 4 moving in the right-to-left direction. The checker-board pattern also includes rows 2 and 4 formed by a print head 4 moving in the left-to-right direction.

As shown in FIG. 7, when the print head is traveling in the right-to-left direction to form rows 1,3 and 5, the spot patterns 410 formed at each pixel position are elongated. In contrast, the spot patterns 420, formed by the print head moving in the right-to-left direction when forming rows 2 and 4, are compressed.

Figure 8:
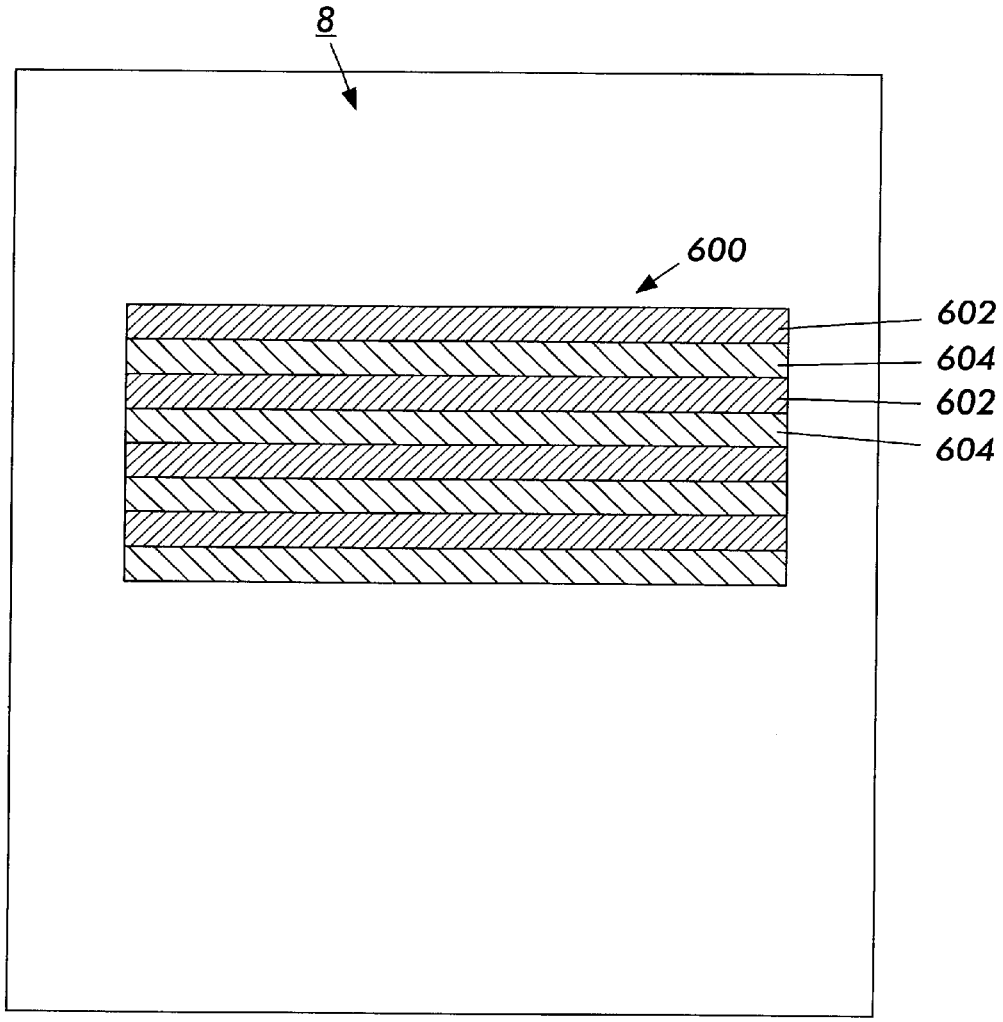
FIG. 8 is an exemplary image formed on a receiving member having a banding pattern.

The aggregate effect of the directional distortion of the spot patterns 410 and 420 is shown in FIG. 8. FIG. 8 illustrates the banding effect that occurs in an image 600 due to the directionally distorted spot patterns 410 and 420 formed on the recording medium 8. In FIG. 8, the swaths 602 formed by the print head 4 moving in the left-to-right direction appears slightly different than the swath 604 formed by the print head 4 moving in the right-to-left direction. This distortion effect is commonly referred to as banding because the final image 600 formed on the recording medium 8 appears to be formed by a series of differing horizontal bands 602 and 604.

Figure 9:
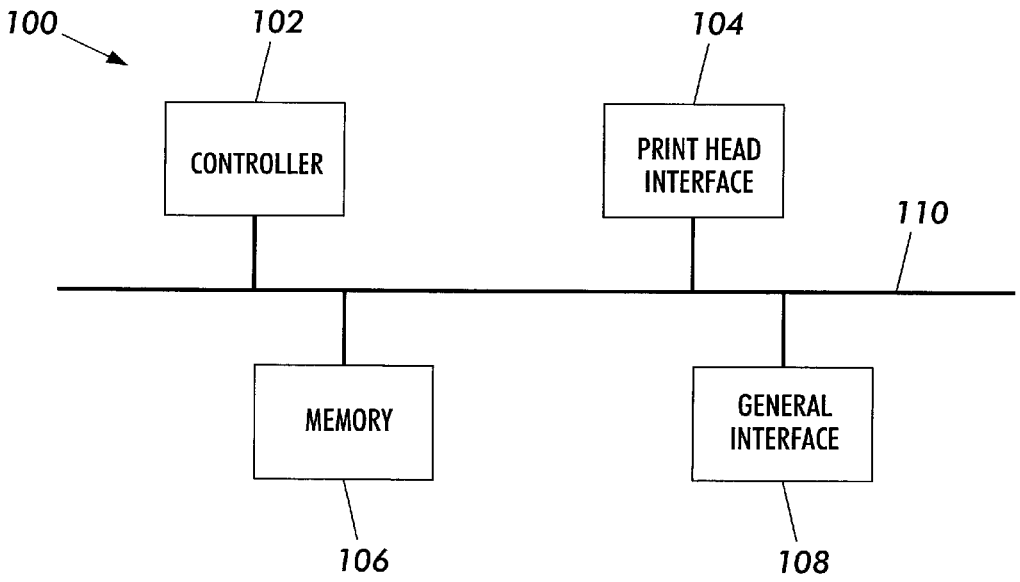
FIG. 9 is an exemplary block diagram of the print controller of FIG. 1, according to the present invention.

FIG. 9 is a block diagram of one exemplary embodiment of the printer controller 100. The printer controller 100 includes a controller 102, a print head interface 104, a memory 106, and a general interface 108, connected together by a control/signal bus 110. In operation, the controller 102 communicates with the print head 4 and the printer motors 8 and 28 through the print head interface 104 and the general interface 108, respectively, to create an image from image data received from a data source (not shown).

Prior to printing each swath 602 or 604, the controller 102 determines the travel direction of the print head 4. Furthermore, the controller 102 determines the temperature of the ink in the print head 4, in response to a signal from a temperature sensor (not shown) received through the print head interface 104. Based on the determined travel direction of the print head 4, the controller 102 adds an adjustment constant to, or subtracts an adjustment constant from, the determined ink temperature prior to selecting a pre-pulse sequence from the memory 106. The adjustment constant is called a satellite temperature difference adjustment value between right and left printing.

The adjustment value can be a negative or positive number depending on the travel direction of the print head 4 and the orientation or behavior of the satellite drops generated by the print head 4. In one exemplary embodiment, if the controller 102 is only compensating during single direction of print head travel, then the absolute value of the adjustment value may be the amount to be added to or subtracted from the ink temperature (prior to pre-pulse determination) for motion in only one direction. Alternatively, if determined ink temperature is to be adjusted for motion in both directions, then half of the adjustment value will be used to adjust the determined ink temperature for each direction.

Which technique is used can depend on the ink temperature at the start of a page. However, for the best image quality, the technique chosen should remain the same for the duration of the page. The technique selection is made based on consideration of the finite range of control available using the pre-pulse technique. The table of FIG. 3 contains entries for temperatures of 25 to 55 degrees. To make the most of the invention, the adjusted temperatures should stay within that range. If the temperature at the top of page is high, then only temperature reducing adjustments should be made. Conversely, if the temperature at the top of page is low, only temperature increasing adjustments should be made. For intermediate top-of-page temperatures, both reducing and increasing adjustments might be made without exceeding the range of the table.

By increasing or decreasing the apparent ink temperature using the adjustment value prior to selecting a pre-pulse sequence, the selected pre-pulse sequence either heats the ink more or less than would normally be expected for the (actual) determined ink temperature. By doing so, the ink ejected from the nozzle 34 when traveling in a direction that tends to enlarge the effect the satellite drops have on the size of the spot pattern will be heated less than ink ejected from the nozzle 34 when traveling in a direction that tends to reduce the effect the satellite drops have on the size of the spot pattern.

For example, in an exemplary embodiment, assume that the determined ink temperature is 35° C. Furthermore, assume that the adjustment value is 10° C. and that the ink temperature is to be adjusted in both the left-to-right and the right-to-left travel directions of the print head 4. Accordingly, during a first pass of the print head 4 moving in a left-to-right direction, the measured temperature of the ink is decreased by one-half of the adjustment value, i.e., 5° C. from the actual determined temperature. Therefore, the adjusted ink temperature is 30° C. and the pre-pulsing sequence corresponding to the 30° C. entry in the table 300 is used to heat the ink prior to the ink print pulse. By doing so, the ink will be hotter and the size of the spot pattern of the ink will be increased relative to ink pre-pulsed based on the actual determined temperature of 35° C.

During a second pass of the print head 4 moving in a right-to-left direction, the adjusted desired temperature of the ink is increased by one-half of the adjustment value, i.e., 5° C. from the actual determined temperature. Therefore, the adjusted ink temperature is 40° C., and the pre-pulsing sequence corresponding to the 40° C. entry in the table 300 is used to heat the ink prior to the ink print pulse. By doing so, the ink will be cooler and the size of the spot pattern of the ink would be decreased in order to counteract the enlarging influence the print head 4 traveling in the right-to-left direction has on the effect of the satellite drop.

The adjustment value can be in a constant selected based on an average satellite placement of a particular print head 4 design. For example, if a print head 4 design is known, on average, to position a satellite drop slightly to the left of a main drop, then a certain adjustment value can be selected to counteract the placement for all printers using this print head 4.

Alternatively, the adjustment value may be selected using a trial and error method for each individual print head 4. This may either be done by the manufacturer of the print head or by the user of the ink jet printer that includes the print head 4. If it is done by the manufacturer, then the print head 4 may be tested to see where the nozzles 34 are placing satellite drops in relation to the main drop. Once the satellite drop placement is known, the manufacturer may select and store a corresponding adjustment value in the controller 102 and/or memory 106 to counteract the satellite misplacement while the print head 4 is operating.

Alternatively, or in addition to the manufacturer selecting the adjustment value, a user may select an optimum adjustment value by a trial and error process during the printing of images or during a set-up procedure. In this case, the user may vary the adjustment value while printing a series of the same images, and select the adjustment value which produces the best image (i.e., the image having the least amount of banding). In this manner, the adjustment value can be varied in accordance with the user's preference.

Figure 10:
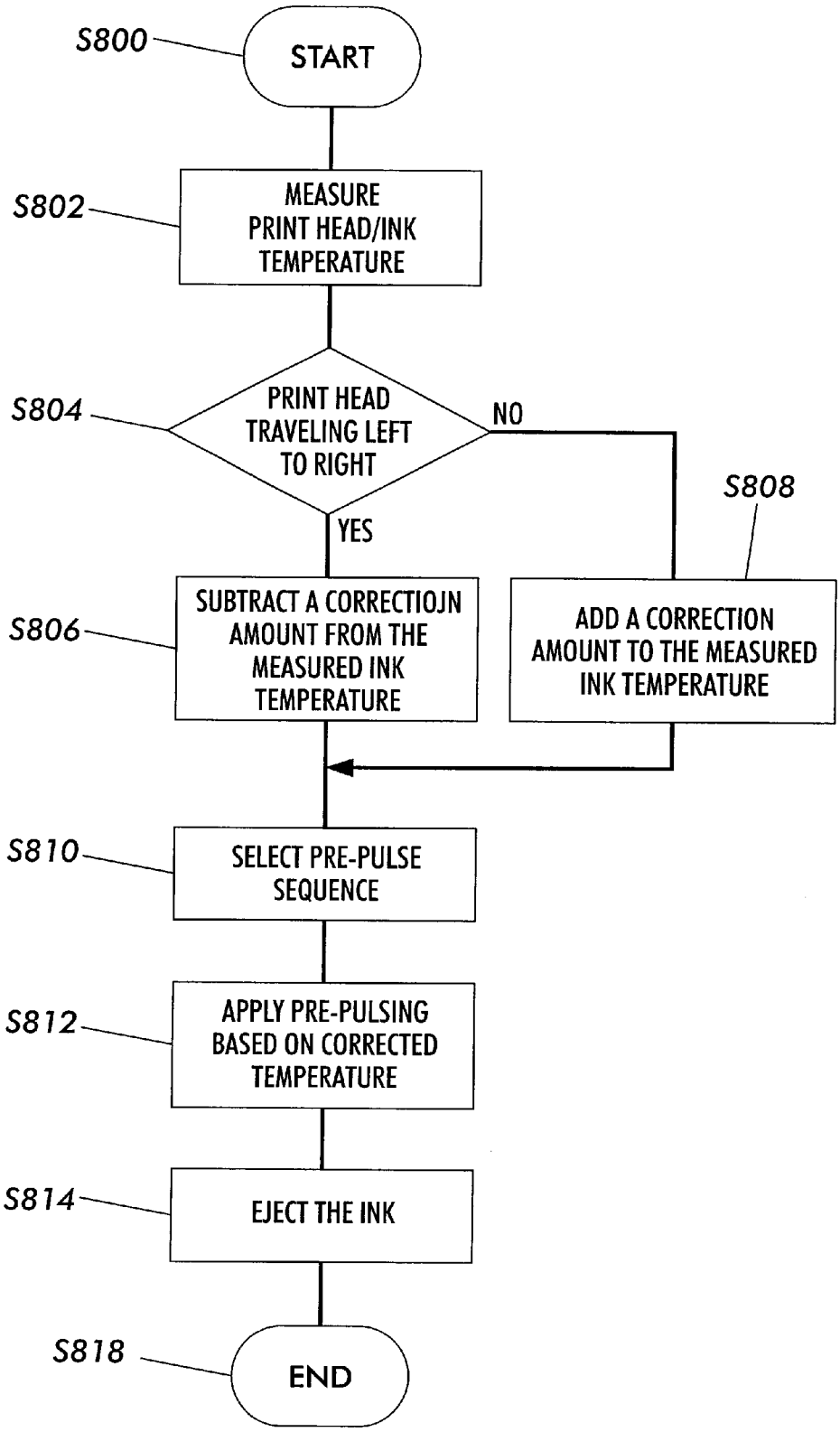
FIG. 10 is a flowchart of an exemplary process of the satellite induced banding prevention system according to the present invention.

FIG. 10 is a flowchart outlining one exemplary embodiment of a method for reducing satellite-induced banding in an image. In step S800, the process begins when a controller receives a request to print a swath. Next, in step S802, the temperature of the ink in the print head is determined. The temperature of the ink in the print head may be measured directly or may be determined to be a temperature close to that of the print head. Next, in step S804, a determination is made whether the print head is traveling in an enlarging direction or a compressing direction. If the print head is traveling in the compressing direction, control proceeds to step S806. Otherwise, control jumps to step S808.

In step S806, a satellite temperature difference adjustment value is subtracted from the determined ink temperature to create an adjusted ink temperature. Control then jumps to step S810. Alternatively, in step S808, the controller adds an adjustment value to the determined ink temperature to create the adjusted ink temperature. Control then proceeds to step S810.

In step S810, a pre-pulsing sequence is selected from a pre-pulsing sequence table which corresponds to the adjusted ink temperature. Then, in step S812, the pre-pulsing sequence is sent by the controller to the print head interface. Next, in step S814, the printing swath is started and the print head interface uses the stored prepulse sequence at each jet firing during the swath. Control proceeds to step S818 where the controller process ends, only to be restarted when the next swath is ready to be printed.

As shown in FIG. 9, the print controller 100 and print head interface 104 is preferably implemented using an application specific integrated circuit (ASIC). However, both 100 and 104 can also be implemented using any other known or later developed integrated circuit, such as a micro-processor, a micro-controller, a digital signal processor, a hardwired electronic or logic circuit such as a discrete element circuit, a programmable logic device such as a PLD, PLA, FPGA or PAL, or the like. In general, any integrated circuit or logic device capable of implementing a finite state machine that is in turn capable of implementing the flowchart shown in FIG. 10, can be used to implement the print controller 100.

Thus, it should be understood that the block diagram shown in FIG. 9 can be implemented as portions of a suitably designed ASIC or of a system that includes a micro-processor, a micro-controller or a digital signal processor. Alternatively, the block diagrams shown in FIG. 9 can be implemented as physically distinct hardware circuits using a FPGA, a PDL, a PLA or a PAL, or using discrete logic elements or discrete circuit elements. The particular form of the circuitry used to implement the system shown in FIG. 9 will take is a design choice and will be obvious and predictable to those skilled in the art.

While the systems and methods of this invention have been described in conjunction with the specific embodiments outlined above, it is evident that many alternatives, modifications and variations will be apparent to the those skilled in the art. Accordingly, the exemplary embodiments of the systems and methods of this invention, as set forth above, are intended to be illustrative, not limiting. Various changes may be made without departing from the spirit and scope of the invention.

What is claimed is:

1. A method for reducing satellite induced banding in an ink jet printer, including:

determining an adjusted ink temperature for ink in a print head based on a direction of travel of the print head;

adjusting a series of pre-pulses used to heat the ink based on the adjusted ink temperature; and transferring the ink heated according to the adjusted series of pre-pulses onto a recording medium.

2. The method according to claim 1, wherein determining the adjusted ink temperature includes:

determining an ink temperature of the ink in the print head;

adjusting the ink temperature value based on the direction of travel of the print head.

3. The method according to claim 2, wherein the adjusted temperature is greater than the determined ink temperature value if the print head is traveling in a spot size enlarging direction, and the adjusted temperature is less than the determined ink temperature value if the print head is traveling in an ink spot compressing direction.

4. The method according to claim 1, wherein adjusting the series of pre-pulses includes selecting a pre-pulsing pattern based on the adjusted ink temperature.

5. The method according to claim 1, wherein determining the adjusted ink temperature includes:

determining an ink temperature value of the ink in the print head; and adjusting the determined ink temperature value based on the direction of travel of the print head and a satellite temperature difference adjusting value.

6. The method according to claim 5, wherein the satellite temperature difference adjusting value is selected to counteract a displacement of a satellite drop from a main drop when the print head is traveling in a particular direction.

7. The method according to claim 1, wherein the print head is a three-color print head.

8. The method according to claim 7, wherein the three colors are cyan, magenta and yellow.

9. The method according to claim 7, wherein the different colors of the print head are independently adjusted with respect to each other.

10. A device for reducing satellite induced banding in an ink jet printer, comprising:

a print head interface;

a controller coupled to the print head interface that determines an adjusted ink temperature for ink in a print head based on a direction of travel of the print head, adjusts a series of pre-pulses used to heat the ink based on the adjusted ink temperature, and transfers the ink heated according to the adjusted series of pre-pulses onto a recording medium.

11. The device according to claim 10, wherein determining the adjusted ink temperature includes:

determining an ink temperature of the ink in the print head;

adjusting the ink temperature value based on the direction of travel of the print head.

12. The device according to claim 11, wherein the adjusted temperature is greater than the determined ink temperature value if the print head is traveling in a spot size enlarging direction, and the adjusted temperature is less than the determined ink temperature value if the print head is traveling in an ink spot compressing direction.

13. The device according to claim 10, wherein adjusting the series of pre-pulses includes selecting a pre-pulsing pattern based on the adjusted ink temperature.

14. The device according to claim 10, wherein determining the adjusted ink temperature includes:

determining an ink temperature value of the ink in the print head; and adjusting the determined ink temperature value based on the direction of travel of the print head and a satellite temperature difference adjusting value.

15. The device according to claim 14, wherein the satellite temperature difference adjusting value is selected to counteract a displacement of a satellite drop from a main drop when the print head is traveling in a particular direction.

* * * * *